US011383544B2

(12) United States Patent
Yu et al.

(10) Patent No.: US 11,383,544 B2
(45) Date of Patent: Jul. 12, 2022

(54) PRINTABLE MEDIA

(71) Applicant: Hewlett-Packard Development Company, L.P., Spring, TX (US)

(72) Inventors: Haowen Yu, San Diego, CA (US); Xiaoqi Zhou, San Diego, CA (US); Xulong Fu, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/051,073

(22) PCT Filed: Aug. 28, 2018

(86) PCT No.: PCT/US2018/048348
§ 371 (c)(1),
(2) Date: Oct. 27, 2020

(87) PCT Pub. No.: WO2020/046283
PCT Pub. Date: Mar. 5, 2020

(65) Prior Publication Data

US 2021/0252894 A1 Aug. 19, 2021

(51) Int. Cl.
*B41M 5/50* (2006.01)
*B41M 5/52* (2006.01)

(52) U.S. Cl.
CPC ..... *B41M 5/502* (2013.01); *B41M 5/504* (2013.01); *B41M 5/506* (2013.01); *B41M 5/52* (2013.01);

(Continued)

(58) Field of Classification Search
CPC .. B41M 5/502; B41M 5/5218; B41M 5/5236; B41M 5/5254

(Continued)

(56) References Cited

U.S. PATENT DOCUMENTS 5,747,148 A 5/1998 Warner et al.
6,512,160 B1 1/2003 Rutsky (Continued)

FOREIGN PATENT DOCUMENTS

JP 2000079753 3/2000
WO 2011031264 3/2011

(Continued)

OTHER PUBLICATIONS

VERSO Sterling® Ultra (Year: 2021).*

(Continued)

*Primary Examiner* — Betelhem Shewareged
(74) *Attorney, Agent, or Firm* — Thorpe North & Western LLP

(57) ABSTRACT

The present disclosure is drawn to printable media. A printable medium includes a substrate having a first side and a second side. An ink-receiving layer is positioned on the first side of the substrate. The ink-receiving layer includes a colloidal sol. An ink-penetrable layer is positioned on the ink-receiving layer. The ink-penetrable layer includes a binder and polymer particles having a glass transition temperature from 80° C. to 150° C. A repositionable adhesive layer is positioned on the second side of the substrate. A release liner is removably positioned on the repositionable adhesive layer. A friction control layer is positioned on the release liner, where the friction control layer includes a slip aid.

20 Claims, 3 Drawing Sheets

(52) U.S. Cl.
CPC ..... *B41M 5/5218* (2013.01); *B41M 5/5236* (2013.01); *B41M 5/5254* (2013.01); *B41M 5/508* (2013.01)

(58) Field of Classification Search
USPC ..... 428/32.24
See application file for complete search history.

(56) References Cited

U.S. PATENT DOCUMENTS

| | | | | |
|---|---|---|---|---|
| 8,367,176 | B1 | 2/2013 | Biancella et al. | |
| 2004/0061763 | A1* | 4/2004 | Wexler | B41M 5/506 347/105 |
| 2004/0247837 | A1 | 12/2004 | Enlow et al. | |
| 2009/0133827 | A1* | 5/2009 | Wozniak | D21H 19/80 156/277 |
| 2009/0142519 | A1* | 6/2009 | Nagai | B41M 5/502 428/32.18 |
| 2014/0139601 | A1* | 5/2014 | Pal | B41M 5/506 347/105 |
| 2018/0008252 | A9 | 1/2018 | Zhou et al. | |
| 2018/0022138 | A1 | 1/2018 | Zhou et al. | |

FOREIGN PATENT DOCUMENTS

| | | |
|---|---|---|
| WO | 2013015767 | 1/2013 |
| WO | 2017078728 | 5/2017 |
| WO | 2017105409 | 6/2017 |

OTHER PUBLICATIONS

International Search Report dated May 23, 2019 for PCT/US2018/048348, Applicant Hewlett-Packard Development Company, L.P.

* cited by examiner

PRINTABLE MEDIA

BACKGROUND

Home printing has allowed for easily customizable prints to be made in the homes of consumers. Inkjet printing in particular has become a popular way of recording images on various types of media. Some of the reasons include low printer noise, variable content recording, low cost, and/or multi-color recording. Other types of home printers have also become more capable and affordable, such as electrophotographic printers that print using toner. As the popularity of inkjet printing increases, the types of use also increase providing demand for new types of inks or recording media.

DETAILED DESCRIPTION

Figure 1:
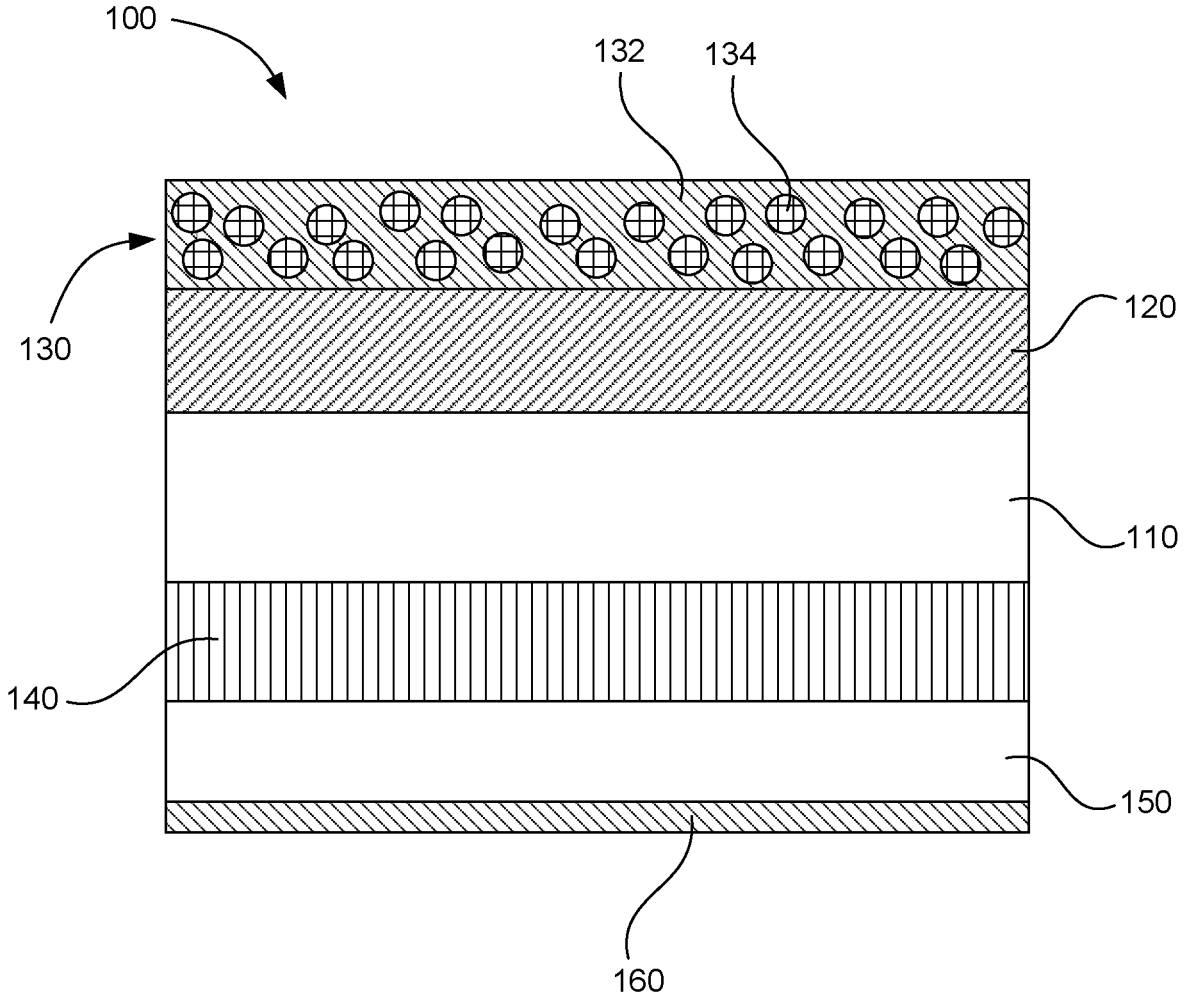
FIG. 1 is a cross-sectional view illustrating an example printable medium prepared in accordance with examples of the present disclosure.

The present disclosure describes printable media and methods of making printable media. A printable medium includes a substrate having a first side and a second side, an ink-receiving layer positioned on the first side of the substrate, an ink-penetrable layer positioned on the ink-receiving layer, a repositionable adhesive layer positioned on the second side of the substrate, a release liner removably positioned on the repositionable adhesive layer, and a friction control layer positioned on the release liner. The friction control layer includes a slip aid. The ink-penetrable layer includes a binder and polymer particles having a glass transition temperature from 80° C. to 150° C. The ink-receiving layer includes a colloidal sol. In further examples, the substrate can have an opacity of 94% to 100%. In other examples, the substrate can be a cellulose base, a non-woven paper base, or a non-woven synthetic fiber base. In yet another example, the printable medium can include an ink fixing layer positioned between the ink-receiving layer and the substrate. The ink fixing layer can include a cationic salt. In still another example, the ink-receiving layer can include an ionene compound. In additional examples, the polymer particles of the ink-penetrable layer can have an average particle size from 0.1 micrometer to 2 micrometers. In some examples, the polymer particles of the ink-penetrable layer can include a cationic polymer having a zeta potential from +1 mV to +50 mV. In still further examples, the repositionable adhesive layer can include continuous matrix polymer adhesive particles, and plastic particles. In certain examples, the continuous matrix polymer can include polymer particles having an average particle size from 50 nanometers to 800 nanometers. A ratio of the average particle size of the adhesive particles to the average particle size of the continuous matrix polymer can be from 20:1 to 100:1. In another example, the slip aid can be a polymeric slip aid.

The present disclosure also extends to methods of printing. In one example, a method of printing can include jetting a non-latex ink onto a printable medium using a thermal inkjet printer. The ink can include a colorant and a solvent. The printable medium can include a substrate having a first side and a second side, an ink-receiving layer positioned on the first side of the substrate, an ink-penetrable layer positioned on the ink-receiving layer, a repositionable adhesive layer positioned on the second side of the substrate, a release liner removably positioned on the repositionable adhesive layer, and a friction control layer positioned on the release liner. The ink-receiving layer can include a colloidal sol. The ink-penetrable layer can include a binder and polymer particles having a glass transition temperature from 80° C. to 150° C. The friction control layer can include a slip aid. In further examples, the polymer particles of the ink-penetrable layer can include cationic polymer particles having a zeta potential from +1 mV to +50 mV having an average particle size from 0.1 micrometer to 2 micrometers. In still further examples, the repositionable adhesive layer can include a continuous matrix or polymer particles having an average particle size from 50 nanometers to 800 nanometers, adhesive particles, and plastic particles. A ratio of the average particle size of the adhesive particles to the average particle size of the continuous matrix polymer particles can be from 20:1 to 100:1.

The present disclosure also extends to methods of making printable media. In one example, a method of making a printable medium can include applying an ink fixing layer to a first surface of a substrate. The ink fixing layer can include a fixing agent. An ink-receiving layer can be applied over the ink fixing layer. An ink-penetrable layer can be applied over the ink-receiving layer. The ink-penetrable layer can include a binder and polymer particles having a glass transition temperature from 80° C. to 150° C. A repositionable adhesive layer can be applied to a second surface of the substrate. A release liner can be applied over the repositionable adhesive layer. The release liner can include a friction control layer with a slip aid. In a particular example, the polymer particles of the ink-penetrable layer can include cationic polymer particles having a zeta potential from +1 mV to +50 mV having an average particle size from 0.1 micrometer to 2 micrometers.

The printable media described herein can be used to print custom designed decals that can be applied to various surfaces such as walls for wall decoration. Thus, in one example, the printable medium can be a printable wall decal medium, which can be used to make customized wall decals or wallpapers for decorating the walls of a user's home or business, for example. In certain examples, the media can be easily used with home printers such as inkjet printers or toner-based printers. Many printable decals currently available have been designed for printing with large format commercial printers. Customers may have wall decorations printed on such media at a professional print shop. However, this can be inconvenient compared to printing at home with a consumer desktop printer. Some customers may not desire to decorate a whole wall, but instead they may want to decorate a partial wall and have the ability to change the wall decor at any time. The printable media described herein can allow for this type of easy customization. Most desktop printers print with dye-based ink, pigment-based ink or dry toner. Much of the currently available printable media has been designed to be printed on with latex-based inks, and is not suitable to be printed by these desktop printers. However, the printable media described herein can be used with various desktop printers and can provide high image quality and durability. The printable media can also include a repositionable adhesive layer to allow easy installation, repositioning and removal without damaging the wall. The wall decal media can have good tensile and tear strength performance, making the media strong enough to be peeled off from the wall without tearing the media or leaving any media residuals on the wall.

Alternatively, in addition to decorating walls, the printable media described herein can also be used to make decals for other surfaces. For example, the printable media can be used to make printed custom decals for windows, automobiles, bicycles, boats, and any other surfaces desired by a user.

FIG. 1 shows an example printable medium 100. The medium includes a substrate 110. An ink-receiving layer 120 is positioned on a first side of the substrate. An ink-penetrable layer 130 is positioned on the ink-receiving layer. The ink-penetrable layer includes a binder 132 and polymer particles 134 having a glass transition temperature from 80° C. to 150° C. A repositionable adhesive layer 140 is positioned on a second side of the substrate. A release liner 150 is removably positioned on the repositionable adhesive layer. A friction control layer 160 is positioned on the release liner. The friction control layer can include a slip aid. It should be noted that FIG. 1 is not drawn to scale, and the printable medium can normally have a very small thickness compared to the length and width of the media. Additionally, the thickness of the various layers can vary for each individual layer. Thus, the thicknesses of the layers shown in FIG. 1 are not limiting.

In certain examples, the printable medium can be cuttable using cutting instruments such as scissors, paper cutters, craft knives, and so on. At the same time, the medium can be sufficiently strong to adhere the medium to a wall and then peel the medium off the wall and reposition the medium without tearing the medium. In some examples, printable media can be manufactured in a large sheet or roll and then cut into smaller sheets. The media can be sold to consumers as sheets having standard dimensions for home printing, such as A4 size, 8.5 inch by 11 inch size, and so forth.

In certain examples, the substrate can be a sheeting material that is strong enough to be peeled from a wall and repositioned without tearing. In a particular example, the substrate can meet or exceed Type I standard according to Federal specification CCC-W-408D, having a breaking strength that is not less than 40 pound-force (lbf) in machine direction and not less than 30 lbf in cross machine direction. As used herein, "machine direction" refers to the direction parallel to the direction in which a paper web travels as it is formed on a paper making machine. The "cross machine direction" is the direction perpendicular to the machine direction. The tear resistance of the substrate can be not less than 192 gram-force (gf) in both machine and cross machine direction without weight. The breaking strength can be measured using the Grab method according to ASTM D 751. The tear resistance can be measured using method A of ASTM D 751.

In one example, the substrate can be opaque. More particularly, in one example the substrate can have an opacity from 94% to 100%. The opacity can be measured by the TAPPI 425 test method. Thus, the substrate can have a sufficient opacity to hide the color of the surface to which the media is adhered. In alternative examples, the substrate can be transparent or partially transparent.

In additional examples, the substrate can have a weight in the range of 75 grams per square meter (gsm) to 300 gsm. In one example, the substrate can be a cellulose base. The cellulose base can be made from pulp stock including hardwood, softwood and mineral filler. The ratio of hardwood to softwood can be from 90:10 to 50:50. The hardwood fibers can have an average length ranging from about 0.5 mm to about 1.5 mm. These relatively short fibers can help the formation and smoothness of the base. In one example, suitable hardwood fibers can include pulp fibers derived from deciduous trees (angiosperms), such as birch, aspen, oak, beech, maple, and eucalyptus. The hardwood fibers can be bleached or unbleached hardwood fibers. Rather than using just virginal hardwood fibers, other fibers with the same length can be used in an amount up to about 20% of the total hardwood fiber content. The other fibers can be recycled fibers, deinked fibers, unbleached fibers, synthetic fibers, mechanical fibers, or combinations thereof. The softwood fibers can have an average length ranging from about 2 mm to about 7 mm. These relatively long fibers can increase the mechanical strength of the base. In one example, suitable softwood fibers can include pulp fibers derived from coniferous trees (gymnosperms), such as varieties of fir, spruce, and pine (e.g., loblolly pine, slash pine, Colorado spruce, balsam fir, and Douglas fir). The fibers can be prepared via any pulping process, such as, for example, chemical pulping processes. Two suitable chemical pulping methods include the kraft process and the sulfite process. The fibers may also be mechanically pulped, thermomechanically pulped, or chemi-thermomechanically pulped.

The pulp used to make the cellulose base can also include up to 10 wt % (with respect to total solids) of additives. Suitable additives can include a dry strength additive, a wet strength additive, a filler, a retention aid, a dye, an optical brightening agent, e.g., optical brightener, a surfactant, a sizing agent, a biocide, a defoamer, or a combination thereof. To have high enough stiffness as wall decals, the basis weight of the cellulose base can be from 75 gsm to 300 gsm.

In another example, the substrate can be based on nonwoven synthetic fibers, such as a Tyvek® base. Tyvek® is a nonwoven product consisting of spunbond olefin fiber. Olefin fiber is a synthetic fiber made from a polyolefin, such as polypropylene or polyethylene. The fibers can be from 0.5 micrometer to 10 micrometers in length. The nondirectional fibers (plexifilaments) are first spun and then bonded together by heat and pressure, without binders. Tyvek® material can be strong and difficult to tear but can easily be cut with scissors or a knife. Water vapor can pass through Tyvek®, but liquid water cannot.

In a further example, the substrate can be a polymeric film, such as a polyethylene terephthalate (PET) film base. PET is made of polymerized units of the monomer ethylene terephthalate, with repeating ($C_{10}H_8O_4$) units. PET film is a thermoplastic polymer referred to as Mylar® polyester film. Like most thermoplastics, PET films can be biaxially oriented (BOPET film), bubble extruded, and co-extruded (co-extruded PET film). PET film may not become brittle with age under normal conditions because there are no plasticizers in the film. The film can be archival quality, dimensionally stable, chemical resistant, color consistent, having good clarity, non-yellowing, non-tearing, having a temperature range of −100° F. to 300° F., electrically insulating, having balanced tensile properties, and having excellent moisture resistance, e.g., non-wettable.

In yet another example, the substrate can be a polyvinyl chloride (PVC) film base. PVC is produced by polymerization of the vinyl chloride monomer (VCM). The product of the polymerization process is unmodified PVC. Before PVC can be made into finished products, it can be converted into a compound by the incorporation of additives such as heat stabilizers, UV stabilizers, plasticizers, processing aids, impact modifiers, thermal modifiers, fillers, flame retardants, biocides, blowing agents, smoke suppressors, and pigments. Flexible PVC can be made by the addition of plasticizers, the most widely used being phthalates.

In another example, the substrate can be a nonwoven paper base. Nonwoven paper can be made of a blend of natural and synthetic fibers. Nonwoven paper can be easy to install and remove, tear-resistant, lightweight, environmental friendly, washable and breathable. Natural fibers used for nonwoven paper can include but are not limited to wood pulp, jute, hemp, flax, sisal and cotton. Synthetic fibers used for nonwoven paper can include but are not limited to polyester, polyolefin and polypropylene. Synthetic fibers can increase strength, stability, versatility, flexibility, efficiency, and so on of the nonwoven paper.

As mentioned above, an ink-receiving layer is positioned on the substrate. As used herein, "positioned on" and "applied on" can refer to a layer that is applied over another layer of the medium, whether or not there are intervening layers. In a certain example, another layer can be placed between the substrate and the ink-receiving layer. In an alternative example, the ink-receiving layer can be in direct contact with the substrate. In either example, the ink-receiving layer can be referred to as being positioned on the substrate.

In some examples, the ink-receiving layer can help control dot gain when printing. Dot gain refers to diameter of halftone dots increasing during the printing process. Total dot gain is the difference between the dot size on the source file and the corresponding dot size on the printed result. Dot gain makes material look darker than intended. However, a certain degree of dot gain can be desirable for hiding missing nozzle defects during printing. However, excessive dot gain can be avoided because it can result in ink bleed defects and damage edge quality of the print-out.

The ink-receiving layer includes a "colloidal sol." Colloidal sols can have an average particle size from 2 to 100 nanometers and a surface area from 20 to 800 square meters per gram. The colloidal sol can include nano-size particles of a metal oxide such as aluminum oxide, silicon oxide, zirconium oxide, titanium oxide, calcium oxide, magnesium oxide, barium oxide, zinc oxide, boron oxide, and mixtures thereof. In one example, the colloidal sol can include 14% aluminum oxide and 86% silicon oxide. The nanoparticles can be cationically or anionically charged and stabilized by various opposite charged groups such as chloride, sodium, ammonium, or acetate ions. Specific examples of colloidal sols include Nalco® 8676, Nalco® 1056, Nalco® 1057, as supplied by NALCO Chemical Company; LUDOX®/SYTON® such as LUDOX® HS40 and HS30, TM/SM/AM/AS/LS/SK/CL-X and LUDOX® TMA from Grace Inc., ULTRA-SOL® 201A-280/140/60 from EMINESS Technologies Inc.

As used herein, "average particle size" refers to a number average of the diameter of the particles for spherical particles, or a number average of the volume equivalent sphere diameter for non-spherical particles. The volume equivalent sphere diameter is the diameter of a sphere having the same volume as the particle. Average particle size can be measured using a particle analyzer such as the MASTERSIZER™ 3000 available from Malvern Panalytical. The particle analyzer can measure particle size using laser diffraction. A laser beam can pass through a sample of particles and the angular variation in intensity of light scattered by the particles can be measured. Larger particles scatter light at smaller angles, while small particles scatter light at larger angles. The particle analyzer can then analyze the angular scattering data to calculate the size of the particles using the Mie theory of light scattering. The particle size can be reported as a volume equivalent sphere diameter.

The surface area of the colloidal sol particles refers to the total surface area in meters of a gram of dry particles. The surface area can also be measured using a MASTERSIZER™ 3000 particle analyzer, as described in the user manual of the MASTERSIZER™ 3000 available from Malvern Panalytical.

In another example, the sol can be prepared using agglomerates which can have the chemical structure as described with a starting particle size from 5 micrometers to 10 micrometers. The sol can be obtained by breaking the agglomerates using chemical separation and mechanical shear force energy. A monovalent acid such as nitric, hydrochloric, formic or acetic acid with a PKa value of 4.0 to 5.0 can be used. In some examples, the agglomerates can be commercially available agglomerates available from Sasol, Germany with the trade name of DISPERAL® or from Dequenne Chimie, Belgium with the trade name DEQUADIS® HP.

In addition to the colloidal sol, the ink-receiving layer includes a polymeric binder. The binder can bind the colloidal sol particles together and to the surface of the substrate or other layer that is positioned beneath the ink-receiving layer. In one example, the binder can be a non-ionic binder. Examples of such binders can include binders commercially available for example from Dow Chemical Inc., marketed as AQUASET™ and RHOPLEX™ emulsions, or polyvinyl alcohol marketed as POVAL®, MOWIOL® and MOWIFLEX® by KURARAY American Inc. In certain examples, the amount of binder in the ink-receiving layer can be from 5 parts by dry weight to 25 parts by dry weight per 100 parts of colloidal sol nanoparticles by dry weight.

In further examples, a dye fixing agent can be included in the ink-receiving layer. The dye fixing agent used in the ink-receiving layer can be a water-soluble compound that does not interact with water-soluble polymers or cross-linking agents in the ink-receiving layer. In addition, the dye fixing agent may not adversely impact the printing process. In one example, the dye fixing agent can be a cationic polymer, such as a polymer having a primary amino group, a secondary amino group, a tertiary amino group, a quaternary ammonium salt group, or a quaternary phosphonium salt group. In further examples, the dye fixing can be in a water-dispersible form. Examples of water-soluble cationic polymers can include, but are not limited to, a polyethyleneimine; a polyallylamine; a polyvinylamine; a dicyandiamide-polyalkylenepolyamine condensate; a polyalkylenepolyamine-dicyandiamideammonium condensate; a dicyandiamide-formalin condensate; an addition polymer of epichlorohydrin-dialkylamine; a polymer of a diallyldimethylammonium salt (polyDADMA), e.g., chloride salt ("DADMAC"); a copolymer of diallyldimethylammoniumchloride-SO2, polyvinylimidazole, polyvinylpyrrolidone; a copolymer of vinylimidazole, polyamidine, chitosan, cationized starch, polymers of vinylbenzyltrimethylammoniumchloride, (2-methacryloyloxyethyl)trimethyl-ammoniumchloride, and polymers of dimethylaminoethylmethacrylate; or a polyvinylalcohol with a pendant quaternary ammonium salt. Examples of the water-soluble cationic polymers that are available in latex form and are suitable as mordants are TRUDOT P-2604, P-2606, P-2608, P-2610, P-2630, and P-2850 (available from MeadWestvaco Corp. (Stamford, Conn.)) and RHOPLEX® Primal-26 (available from Rohm and Haas Co. (Philadelphia, Pa.)). In other examples, cationic polymers having a lesser degree of water-solubility can be included by dissolving the polymers in a water-miscible organic solvent.

In some examples, the ink-receiving layer can include an ionene compound. The ionene compound refers to a polymer having ionic groups as part of the main chain, where ionic groups can exist on the backbone unit, or exist as the appending group to an element of the backbone unit, e.g., the ionic groups are part of the repeating unit of the polymer. In one example, the ionene is a cationic charged polymer. The ionene can be a naturally occurring polymer such as cationic gelatin, cationic dextran, cationic chitosan, cationic cellulose, and cationic cyclodextrin. The ionene can be a naturally based polymer but synthetically modified such as based on chitosan (natural), but change structure as carboxymethyl chitosan and N,N,N-trimethyl chitosan chloride (synthetic).

In one example the ionene is the polymer having ionic groups as part of the main chain, where ionic groups exist on the backbone unit, for example an alkoxylated quaternary polyamine can be used, which may include side groups of linear or branched $C_2$-$C_{12}$ alkylene, $C_3$-$C_{12}$ hydroxyalkylene, $C_4$-$C_{12}$ dihydroxyalkylene, or dialkylarylene. The nitrogens along the backbone can be quaternized.

In further detail, the ionene compound can be a polymer having ionic groups as part of the main chain, but exist as the appending group to an element of the backbone unit, e.g., the ionic groups are not on the backbone but are part of the repeating unit of the polymer, such as quaternized poly(4-vinyl pyridine). In other examples the ionene can be a homopolymer of diallyldimethylammonium salt (poly-DADMA), e.g., chloride salt.

In another example, the ionene can be polyamines and/or their salts, polyacrylate diamines, quaternary ammonium salts, polyoxyethylenated amines, quaternized polyoxyethylenated amines, polydicyandiamide, polydiallyldimethyl ammonium chloride polymeric salt, or quaternized dimethylaminoethyl(meth)acrylate polymers.

In still further examples, the ionene can be polyimines and/or their salts, such as linear polyethyleneimines, branched polyethyleneimines, quaternized polyethyleneimine. In other examples the ionene can be a substitute polyuria such as poly[bis(2-chloroethyl)ether-alt-l,3 bis[3-(dimethylamino)propyl]urea], or quaternized poly[bis(2 chloroethyl)ether-alt-l,3-bis [3-(dimethylamino)propyl]. In further examples the ionene can be a vinyl polymer and/or their salts such as quaternized vinylimidazol polymers, modified cationic vinylalcohol polymers, alkylguanidine polymers, and/or combinations thereof.

The printable medium also includes an ink-penetrable layer positioned on the ink-receiving layer. In some examples, the ink-penetrable layer can be the outermost layer on the printing side of the medium. This layer can increase water resistance of the medium, e.g., waterfastness of images printed on the medium, and reduce smearing and smudging of images printed on the medium. For example, the ink-penetrable layer can be a discontinuous film that includes pathways for ink to penetrate down through the layer. As such, the ink-penetrable layer can include polymer particles that do not form a continuous film at conditions encountered during preparation, and subsequent printing, storage, transportation, etc. In this respect, the ink-penetrable layer can be described as being porous. In some examples, the ink-penetrable layer can be relatively thin, having a coat weight not greater than 3 gsm. Coat weight more than 3 gsm can have negative impact on bleed performance. In certain examples, the coat weight can be from 0.5 gsm to 3 gsm.

The ink-penetrable layer includes a binder and polymer particles having a glass transition temperature from 80° C. to 150° C. Because the polymer particles have a high glass transition temperature, the polymer particles can be non-film forming. Thus, the polymer particles can remain separate and distinct particles instead of consolidating into a continuous film. The polymer particles can allow the layer to be porous, and therefore allow ink to penetrate through the layer to the ink-receiving layer and optional ink fixing layer below. In contrast, if polymer particles having a lower glass transition temperature were used, then the particles could form a film and result in a non-porous layer that would not allow ink to penetrate through. In further examples, the polymer particles can be a cationic, anionic, or nonionic polymer. Specific examples of the polymer particles can include acrylic polymers and/or styrene-acrylic polymers. In certain examples, the polymer particles can provide a uniform gloss level to the medium and good adhesion for colorants such as dyes and pigments printed onto the medium. The adhesion between the ink-penetrable layer and the ink colorant can provide resistance to smearing and/or smudging. The ink-penetrable layer also provides resistance to smearing and smudging by allowing ink to penetrate down to the ink-receiving layer and optional ink fixing layer below.

In further examples, the polymer particles can have an average particle size from about 0.1 micrometer to about 2 micrometers. In another example, the polymer particles can have an average particle size ranging from about 0.1 micrometer to about 1 micrometer. In certain examples, the polymer particles can be a cationic polymer having a zeta potential (ZT) ranging from about +1 mV to about +50 mV, and in another example, the zeta potential can be greater than about +25 mV. One example of the cationic polymer is RAYCAT® 78, which is a polyacrylic emulsion polymer commercially available from Specialty Polymers, Inc., Woodburn, Oreg., and which has a zeta potential of about +34 mV. Zeta potential is another property that can be measured using a Mastersizer™ 3000 particle analyzer, as described in the user manual available from Malvern Panalytical.

In alternative examples, the polymer particles can be a non-film forming anionic polymer such as non-film forming anionic acrylic polymers and/or non-film forming anionic styrene-acrylic polymers. The anionic polymer can have, in one example, a zeta potential (ZT) ranging from about −1 mV to about −60 mV. One example of such an anionic polymer is RAYCAT® 30S, which is an acrylic emulsion polymer commercially available from Specialty Polymers, Inc., Woodburn, Oreg., and which has a zeta potential of about −58 mV. Another example of the anionic polymer is JONCRYL® ECO 2189, which is a styrene-acrylic polymer commercially available from BASF Corp., Ludwigshafen, Germany, and which has a zeta potential of about −48 mV.

The polymer particles (whether they are a cationic polymer or an anionic polymer) can have a glass transition temperature from about 80° C. to about 150° C., and in another example, the glass transition temperature can be from about 105° C. to about 120° C. In still another example, the polymer particles can have a glass transition temperature from about 90° C. to about 135° C. These glass transition temperature ranges can be used to allow the particles to remain separate and not to form films at the temperature conditions encountered during printing, storage, and transportation of the media.

Glass transition temperature can be measured using differential scanning calorimetry according to ASTM D6604: Standard Practice for Glass Transition Temperatures of Hydrocarbon Resins by Differential Scanning calorimetry. Differential scanning calorimetry can be used to measure the heat capacity of the polymer across a range of temperatures. The heat capacity can jump over a range of temperatures around the glass transition temperature. The glass transition temperature itself can be defined as the temperature where the heat capacity is halfway between the initial heat capacity at the beginning of the jump and the final heat capacity at the end of the jump.

In one example, the polymer particles can be present in an amount from about 20 wt % to about 95 wt % by dry weight of the ink-penetrable layer, and in another example, in an amount from about 30 wt % to about 95 wt %. In still another example, the polymer particles can be present in an amount from about 40 wt % to about 95 wt %.

As previously mentioned, the ink-penetrable layer includes a binder. In some examples, the binder can be a water-dispersible binder (such as water-dispersible latexes) or a water-soluble binder. Some specific examples of water-dispersible binders can include acrylic polymers, acrylic copolymers, vinyl acetate latex, polyesters, vinylidene chloride latex, styrene-butadiene copolymer latex, styrene/n-butyl acrylate copolymer (such as, e.g., ACRONAL® S728, available from BASF Corp., Ludwigshafen, Germany), and/or acrylonitrile-butadiene copolymer latex. Examples of water-soluble binders can include polyvinyl alcohol (such as MOWIOL® 4-98 and MOWIOL® 40-88, both available from Kuraray America, Inc., Houston, Tex.), polyvinyl acetates, starches, gelatin, celluloses, and/or acrylamide polymers. In certain examples, the amount of binder present can be from about 3 wt % to about 15 wt % by dry weight of the ink-penetrable layer. In another example, the amount of binder can be from about 5 wt % to about 10 wt % by dry weight of the ink-penetrable layer.

In some cases, the ratio of polymer particles to binder in the ink-penetrable layer can contribute to the porosity or discontinuous character of the ink-penetrable layer. For example, the ratio can be such that the binder binds the polymer particles together while still leaving open void space between polymer particles to allow ink to penetrate through the layer. In certain examples, the ratio of polymer particles to binder in the ink-penetrable layer can be from about 50:1 to about 2:1. In further examples, the ratio can be from about 40:1 to about 4:1. In still further examples, the ratio can be from about 25:1 to about 10:1. These ratios, for example, can provide a porosity that allows for ink penetration of the ink-penetrable layer, but also can provide some water-resistivity and durability enhancement to the printed medium As used herein, "porosity," "porous," "discontinuous," etc., refers to the ink-penetrable layer and can be quantified by the percentage of void volume present relative to the total geometric volume of the ink-penetrable layer, e.g., volume of ink-penetrable layer not occupied by polymer particles, binder, or other solid ingredients. Geometric volume can be calculated by measuring (length by width by thickness including void volume) of the ink-penetrable layer including all material and voids collectively. Void volume can be measured similarly, but measuring the volumes where there are no solids present. A layer can be sampled at a plurality of locations, e.g., five, and averaged. In one example, the porosity or void (open) volume of the ink-penetrable layer can be from about 5% to about 60%, from about 10% to about 60%, or from about 20% to about 50%. The relative volumes can be measured, such as by sampling the layer and imaging with sufficient resolution for taking volumetric measurement, e.g., using a scanning electron microscope or other imaging techniques.

A repositionable adhesive layer is positioned on the opposite side of the substrate from the ink-receiving layer. The repositionable adhesive layer can allow for easy installation, reposition and removal of wall decorations, eliminating the need for paste or water. The repositionable adhesive layer can include a continuous matrix polymer, an adhesive particle, and a plastic particle.

In some examples, the continuous matrix polymer can be a soft and sticky matrix. In some examples, the continuous matrix polymer can include a polyacrylate polymer or a copolymer thereof. The continuous matrix polymer can include, for example, n-butyl acrylate, ethyl acrylate, 2-ethylhexyl acrylate, copolymers of these acrylates with other co-monomers, or combinations with homopolymers of co-monomers thereof. The co-monomers can be methyl methacrylates, t-butyl methacrylate, methyl acrylate, acrylic acid, styrene, natural rubber, synthetic thermoplastic elastomer, silicone rubber, rosins, terpenes, modified terpenes, aliphatic resins, cycloaliphatic resins, aromatic resins, hydrogenated hydrocarbon resins, terpene-phenol resins, derivatives, or combinations thereof. In some examples, the co-monomer can be an aliphatic and aromatic resin that has a 5 or a 9 chain carbon structure. In another example, the continuous matrix polymer can include 2-ethylhexyl acrylate. In a further example, the continuous matrix polymer can include ethyl acrylate. Further in another example, the continuous matrix polymer can be a copolymer of 2-ethylhexyl acrylate (98 wt %) and acrylic acid (2 wt %).

The characteristic of a continuous matrix polymer compared with the other polymers used in the adhesive coating is the particle size of the polymers. The average particle size of continuous matrix polymer can be in nano-scale, ranging from about 50 nanometers to about 800 nanometers. In one example, the average particle size of continuous matrix polymer is 247 nanometers, and in another example, the average particle size of continuous matrix polymer is 502 nanometers. The continuous matrix polymer particles can form a continuous film which holds an adhesive particle, and a plastic particle within the repositionable adhesive layer. The glass transition temperature of the continuous matrix polymer can range from about −100° C. to about −25° C. In one example, the glass transition temperature can range from about −75° C. to about −40° C. In another example, the glass transition temperature can range from about −50° C. to about −20° C.

With respect to the adhesive particle, the adhesive particle can be round, round-like, oval, oval-like, oblong, or oblong-like structure. One surface of these particles can thus serve as a contact point of the adhesive printable film. These particles render it possible for the film to be peeled, applied, re-peeled, and re-applied to a surface. Unlike the continuous matrix polymer, the adhesive particle is formulated as a particle and is not formed as a continuous film layer or matrix. The ratio of particle size of the adhesive particle to that of continuous matrix polymer can be about 20:1 to about 100:1. The quantity of these particles dispersed in the continuous matrix polymer, the particle size, and softness of these particles (as represented by glass transition temperature) are factors that impact the ability of the film to be peeled, applied, re-peeled, and re-applied.

The adhesive particles thus include a different discrete structure compared to the continuous matrix polymer. However, the list of possible polymeric chain structure materials for use as adhesive particles and in the continuous matrix polymer can be different in one example and can be similar in another example. What distinguishes each component from the other is the structure, especially particle size or form for which each is predesigned. The continuous matrix polymer, as the name implies, can be a continuous matrix or field of polymer that is used to support various particles. The adhesive particles, on the other hand, can retain their particulate shape and can be randomly dispersed in the continuous polymer matrix.

The adhesive particles can include water dispersible polymers, latex particles, or combinations thereof. In one example, the adhesive particles can include acrylate polymers, n-butyl acrylate, ethyl acrylate, 2-ethylhexyl acrylate, copolymers of acrylates with co-monomers, or combinations thereof. The co-monomers can be a methyl methacrylate, t-butyl methacrylate, methyl acrylate, acrylic acid, styrene, natural rubber, synthetic thermoplastic elastomer, silicone rubber, or combinations thereof. In another example, the adhesive particles can include an acrylate polymer, a copolymer of an acrylate, a natural rubber, a synthetic rubber, or a combination thereof. In yet another example, the adhesive particles can include ethyl acrylate. Yet in another example, the adhesive particle can be a copolymer of 2-ethylhexyl acrylate (87 wt %), methyl methacrylate (7 wt %), 2-hydroxyethyl acrylate (4 wt %), and acrylic acid (2 wt %). The adhesive particles can have a glass transition temperature ranging from about −100° C. to about 0° C. In another example, the glass transition temperature can range from about −80° C. to about −40° C. In yet another example, the glass transition temperature can range from about −70° C. to about −45° C.

The adhesive particles can have an average particle size from about 10 micrometers to about 250 micrometers. In one example, the average particle size can be about 15 micrometers to about 200 micrometers. In yet another example, the average particle size can be about 20 micrometers to about 100 micrometers. In a further example, the average particle size can be about 25 micrometers to about 40 micrometers.

With respect to the plastic particles, in some examples these particles can serve as a functionalized spacer. The plastic particles can maintain a channel for air flow, which can increase adhesion and contribute to the peelable nature of the film. The plastic particles can include an acrylic polymer or copolymer, a styrene polymer or copolymer, a methacrylate polymer or copolymer, a polyethylene or ethylene copolymer, a polypropylene or propylene copolymer, a polytetrafluoroethylene, a polyester or polyester copolymer, a fluorinated fatty acid, carnauba wax, paraffin wax, or a combination thereof. In one example, the plastic particles are a copolymer of styrene and acrylic. In another example, the plastic particles are a methacrylate polymer. Yet in another example, the plastic particles are a high density polyethylene particle.

The modulus of the plastic particles can be higher than the modulus of the adhesive particles. The modulus of the plastic particle, as represented by a hardness value, can be about 2 dmm or less as measured by ASTM D-5 method where "dmm" is observed penetration depth in tenths of millimeters. In some other examples, the plastic particles can have a hardness value of 1 dmm or less. Yet in another example, the hardness value can be about 0.5 dmm. The average particle size of the plastic particles can be about the same as adhesive particles, or slightly smaller than adhesive particles, ranging from about 8 micrometers to about 200 micrometers. In another example, the plastic particles can have an average particle size that ranges from about 10 micrometers to about 30 micrometers. In general, the plastic particles can have an average particle size that is about 50% to 100% of the size of the adhesive particles. In one example, the plastic particles can have an average particle size of about 30 micrometers, and this can be about the same size as the average size of the adhesive particles.

In some examples, the plastic particles can have an average glass transition temperature from about 10° C. to about 80° C. In another example, the plastic particles can have an average glass transition temperature from about 25° C. to about 60° C.

The continuous matrix polymer can be admixed with adhesive particles and the plastic particles to form the repositionable adhesive layer. The ratio of the continuous matrix polymer to the adhesive polymer can range from about 1:1 parts by weight to about 1:5 parts by weight. The plastic particles can be present at a weight ratio with respect to the continuous matrix polymer and the adhesive particles combined at a range from about 1:100 to about 5:100. In some examples, the glass transition temperature of the plastic particles can be greater than the glass transition temperature of the adhesive particles and the glass transition temperature of the adhesive particles can be comparable with the glass transition temperature of the continuous matrix polymer.

A release liner with a friction control layer is applied over the repositionable adhesive layer. The release line can protect the repositionable adhesive layer until use, provide a release effect against sticky material on one side and provide friction control on the other side. The release liner, in one example, can be paper and in another example, can be PET film. In another example, the release liner can be a silicone layer. The release liner can have an average thickness ranging from 20 micrometers to 100 micrometers.

A slip aid is incorporated into the friction control layer, for example, to reduce sheet-to-sheet friction and to increase the scratch resistance of the medium. Examples of the slip aid can include polyethylene (such as SLIP-AYD® SL 1618 (Elementis Specialties (Hightstown, N.J.)), a polyamide (such as ORGASOL® 2002 ES3 NAT 3 (Arkema Inc., Philadelphia, Pa.)), high density polyethylene (such as ULTRALUBE® E846 (Keim-Additec Surface GmbH, DE)), MICHEMSHIELD® 251, MICHEMSHIELD® 253, and MICHEMSHIELD® 422, all of which are available from Michelman, Inc. Cincinnati, Ohio, and/or combinations thereof. The friction control layer can have a grammage from 0.5 gsm to 2 gsm. A polymeric binder can also be incorporated in the friction control layer. In some examples, the polymeric binder can be any of the polymeric binders described above in the ink-receiving layer.

In certain examples, an ink fixing layer can be positioned between the substrate and the ink-receiving layer. The ink fixing layer can fix pigment colorants in ink printed on the medium. In some examples, the ink fixing layer can receive the ink drops and crash, or separate, ink pigment from ink solvent. The ink fixing layer can also chemically bond the ink pigment and prevent the pigment from penetrating further into the substrate. The ink solvent, however, can flow freely into the substrate if the substrate is absorbent such as paper substrates. Maintaining the pigment at the ink fixing layer can increase color gamut compared to the color gamut that would be achieved if the pigment were allowed to penetrate further into the substrate.

The ink fixing layer can include a fixing agent. In some examples, the fixing agent can include an electrically charged substance. "Electrically charged" refers to the chemical substance with some atoms gaining or losing electrons or protons, together with a complex ion made up of an aggregate of atoms with opposite charges. The charged ion and associated complex ion can be de-coupled in an aqueous environment. One example of such electrical charged substance is an electrolyte, whether low molecular species or high molecular species. Examples of low molecular species include inorganic salts, such as water-soluble and multi-valent charged salts. These may include cations, such as Group I metals, Group II metals, Group III metals, or transition metals, such as sodium, calcium, copper, nickel, magnesium, zinc, barium, iron, aluminum and chromium ions. The associated complex ion can be chloride, iodide, bromide, nitrate, sulfate, sulfite, phosphate, chlorate, acetate ions. In another example, the electrolyte can be an organic salt, such as a water-soluble organic acid salt. The organic salt can include an organic ionic species. The organic salt can be made up of an organic cation and anion, or in some cases one of the ions can be an inorganic ion such as a metal cation. Examples of water-soluble organic acid salts can include metallic acetate, metallic propionate, metallic formate, metallic oxalate, and the like. The organic salt may include a water dispersible organic acid salt. Examples of water dispersible organic acid salts include a metallic citrate, metallic oleate, metallic oxalate, and the like.

The thickness of the ink fixing layer can be from 0.001 micrometer to 1 micrometer. In certain examples, the grammage of the first distinct layer can be up to 1 gsm. In further examples, a ratio of the coating thickness of the ink fixing layer to the coating thickness of the ink-receiving layer can be 1:10 or greater. In still further examples, this ratio can be 1:50 or greater or 1:100 or greater.

Other additives such as binders, deformers and PH adjusters can also be added into the ink fixing layer formulation to modify functional performance such as eliminating foaming during coating process.

In certain examples, the water absorption capability of the ink fixing layer, as measured by the Cobb test as specified by the TAPPI T441OM standard, does not exceed 5% of the water absorption capability of the substrate. In further examples, the water absorption capability of the ink fixing layer does not exceed 3% of the water absorption capability of the substrate.

Any suitable coating method can be used for applying an ink fixing layer, ink-receiving layer, ink-penetrable layer, and repositionable adhesive layer. For example, the layers may be applied using an off-line coater, or use an online surface sizing unit, such as a puddle-size press, film-size press, or the like. The puddle-size press may be configured as having horizontal, vertical, and inclined rollers. In another example, the film-size press may include a metering system, such as gate-roll metering, blade metering, Meyer rod metering, or slot metering. For some examples, a film-size press with short-dwell blade metering may be used as an application head to apply coating solutions. Non-contact coating methods such as spray coating can also be used.

In further examples, each layer applied to the substrate can be either dried or un-dried (e.g., wet-to-wet coating) before applying the next layer. An infrared heater or heated air or a combination dryer can be used for drying. Other drying methods and equipment can also be used.

In certain examples, the release liner can be formed separately from the substrate with the repositionable adhesive layer on one side and the other layers on the opposite side. The release liner can then be pressed in contact with the repositionable adhesive layer. In other examples, the release liner can be formed in place on the repositionable adhesive layer by applying a release liner composition to the repositionable adhesive layer and then drying and/or curing the release liner composition. In certain examples, the release liner can include a cured silicone, and the release liner can be formed by coating the repositionable adhesive layer with an uncured silicone composition and then curing the composition.

Figure 2:
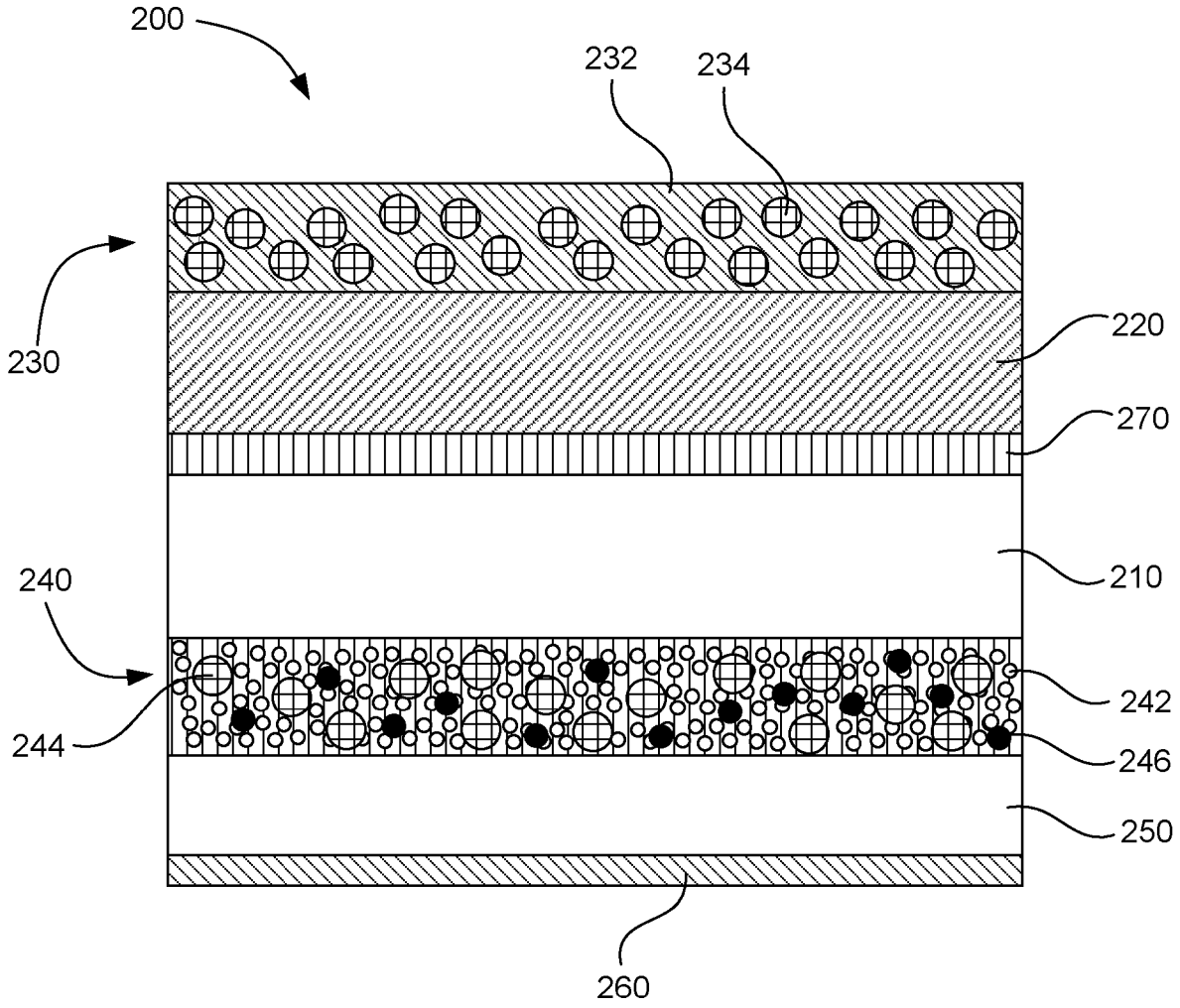
FIG. 2 is a cross-sectional view illustrating an example printable medium in accordance with examples of the present disclosure.

FIG. 2 shows a more specific example of a printable medium 200. The medium includes a substrate sheet 210 having a first side and a second side. An ink fixing layer 270 is in contact with the first side of the substrate sheet. The ink fixing layer can include a fixing agent as described above. An ink-receiving layer 220 is in contact with the ink fixing layer. An ink-penetrable layer 230 is in contact with the ink-receiving layer. The ink-penetrable layer is one of the outermost layers of the medium. The ink-penetrable layer includes a binder 232 and polymer particles 234 having a glass transition temperature from 80° C. to 150° C. A repositionable adhesive layer 240 is in contact with the second side of the substrate sheet. The repositionable adhesive layer includes continuous matrix polymer particles 242, adhesive particles 244, and plastic particles 246. A release liner 250 is in contact with the repositionable adhesive layer. A friction control layer 260 is in contact with the release liner. The friction control layer can include a slip aid, and the friction control layer can be the other outermost layer of the medium. When multiple sheets of the medium are stacked together unidirectionally, the friction control layer of one sheet can contact the ink-penetrable layer of the adjacent sheet.

Figure 3:
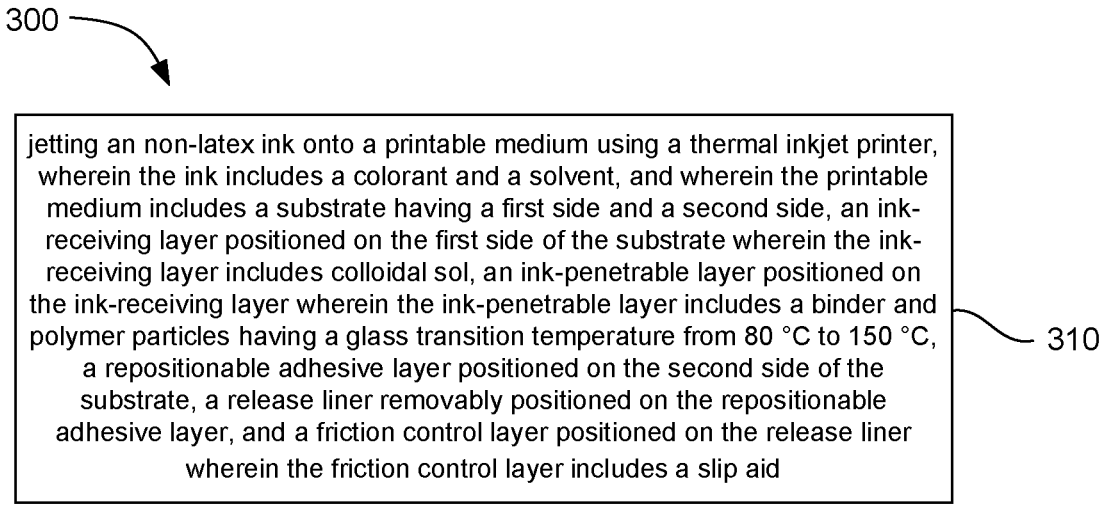
FIG. 3 is a flowchart illustrating an example method of printing in accordance with examples of the present disclosure.

The present disclosure also extends to methods of printing. FIG. 3 is a flowchart of an example method 300 of printing. The method includes jetting 310 a non-latex ink onto a printable medium using a thermal inkjet printer, wherein the ink includes a colorant and a solvent. The printable medium includes a substrate having a first side and a second side, an ink-receiving layer positioned on the first side of the substrate wherein the ink-receiving layer includes colloidal sol, an ink-penetrable layer positioned on the ink-receiving layer wherein the ink-penetrable layer includes a binder and polymer particles having a glass transition temperature from 80° C. to 150° C., a repositionable adhesive layer positioned on the second side of the substrate, a release liner removably positioned on the repositionable adhesive layer, and a friction control layer positioned on the release liner wherein the friction control layer includes a slip aid.

The printing methods described herein include thermally jetting the non-latex ink onto the printable medium using a thermal inkjet printer. As used herein, "thermal inkjet" refers to a process of using heat energy to temporarily form a vapor bubble in ink, where the vapor bubble forces a drop of ink out of the printer onto the printable medium. The ink can be forced out through a nozzle located at an exit of a firing chamber. The vapor bubble can then collapse, allowing more ink to refill the firing chamber. This process can be repeated many times by generating vapor bubbles and firing additional drops of ink.

The ink used with the thermal inkjet printer can be any ink suitable for thermal inkjet printing. In certain examples, the ink can be a non-latex aqueous ink. As used herein, "non-latex" refers to ink that does not include latex as a binder, or if a latex is present, it is present in only a diminimis amount so as to still allow for ink penetration through the ink-penetrable layer and onto the ink-receiving layer, e.g., less than 2 wt % by the total weight of the ink. In some examples, the ink can include colorant and a liquid vehicle, e.g., water, co-solvent, liquid additives such as surfactant, biocide, etc.

In certain examples, the colorant in the ink can include dye, pigment, or both. With specific reference to the pigment, the pigment is not particularly limited. The pigment can be self-dispersed, or can be dispersed by a separate dispersing agent associated with a surface of the pigment. Pigment colorants can include any color, such as cyan, magenta, yellow, red, blue, orange, green, pink, etc., or can include black or white pigment. Suitable organic pigments can include, for example, azo pigments including diazo pigments and monoazo pigments, polycyclic pigments (e.g., phthalocyanine pigments such as phthalocyanine blues and phthalocyanine greens, perylene pigments, perynone pigments, anthraquinone pigments, quinacridone pigments, dioxazine pigments, thioindigo pigments, isoindolinone pigments, pyranthrone pigments, and quinophthalone pigments), nitropigments, nitroso pigments, anthanthrone pigments such as PR168, and the like. Examples of phthalocyanine blues and greens can include copper phthalocyanine blue, copper phthalocyanine green and derivatives thereof such as Pigment Blue 15, Pigment Blue 15:3, and Pigment Green 36. Examples of quinacridones can include Pigment Orange 48, Pigment Orange 49, Pigment Red 122, Pigment Red 192, Pigment Red 202, Pigment Red 206, Pigment Red 209, Pigment Violet 19, and Pigment Violet 42. Examples of anthraquinones can include Pigment Red 43, Pigment Red 194, Pigment Red 177, Pigment Red 216, and Pigment Red 226. Examples of perylenes can include Pigment Red 123, Pigment Red 190, Pigment Red 189, and Pigment Red 224. Examples of thioindigoids can include Pigment Red 86, Pigment Red 87, Pigment Red 198, Pigment Violet 36, and Pigment Violet 38. Examples of heterocyclic yellows can include Pigment Yellow 1, Pigment Yellow 12, Pigment Yellow 13, Pigment Yellow 14, Pigment Yellow 17, Pigment Yellow 73, Pigment Yellow 90, Pigment Yellow 110, Pigment Yellow 117, Pigment Yellow 120, Pigment Yellow 128, Pigment Yellow 138, Pigment Yellow 150, Pigment Yellow 151, Pigment Yellow 155, and Pigment Yellow 213. Other pigments that can be used include Pigment Blue 15:3, DIC-QA Magenta Pigment, Pigment Red 150, and Pigment Yellow 74. Such pigments are commercially available in powder, press cake, or dispersions form from a number of sources.

The pigment load in the ink can range from 2 wt % to 10 wt %. In one example, the pigment load can be from 3 wt % to 7 wt %, or from 5 wt % to 9 wt %. In a further example, the pigment load can be from 4 wt % to 6 wt %, or from 6 wt % to 8 wt %

In further examples, the ink can include a co-solvent. In certain examples, the co-solvent can be an organic co-solvent or a system of multiple organic co-solvents. An organic co-solvent system can include any solvent or combination of solvents that is compatible with the components of the ink. When the liquid vehicle is aqueous, water is one of the solvents (present at from 30 wt % to 75 wt %, or from 40 wt % to 70 wt %, or from 50 wt % to 70 wt %). Examples of suitable classes of co-solvents that can be used include organic co-solvents, which can often be polar solvents such as alcohols, amides, esters, ketones, lactones, and ethers. In additional detail, solvents that can be used can include aliphatic alcohols, aromatic alcohols, diols, glycol ethers, polyglycol ethers, caprolactams, formamides, acetamides, and long chain alcohols. Examples of such compounds include primary aliphatic alcohols, secondary aliphatic alcohols, 1,2-alcohols, 1,3-alcohols, 1,5-alcohols, ethylene glycol alkyl ethers, propylene glycol alkyl ethers, higher homologs ($C_6$-$C_{12}$) of polyethylene glycol alkyl ethers, N-alkyl caprolactams, unsubstituted caprolactams, both substituted and unsubstituted formamides, both substituted and unsubstituted acetamides, and the like. More specific examples of organic solvents can include 2-pyrrolidone, 2-ethyl-2-(hydroxymethyl)-1, 3-propane diol (EPHD), glycerol, N-methylpyrrolidone (NMP), dimethyl sulfoxide, sulfolane, glycol ethers, alkyldiols such as 1,2-hexanediol, and/or ethoxylated glycerols such as LEG-1, etc. Co-solvents can be included in the ink in amount from 2 wt % to 50 wt %, from 5 wt % to 40 wt %, from 10 wt % to 30 wt %, or in another amount within those ranges.

The ink can also include a surfactant. The surfactant can include alkyl polyethylene oxides, alkyl phenyl polyethylene oxides, polyethylene oxide (PEO) block copolymers, acetylenic PEO, PEO esters, PEO amines, PEO amides, dimethicone copolyols, ethoxylated surfactants, alcohol ethoxylated surfactants, fluorosurfactants, and mixtures thereof. In some examples, fluorosurfactants and alcohol ethoxylated surfactants can be used as surfactants. In one example, the surfactant can be Tergitol™ TMN-6, which is available from Dow Chemical Corporation. Notably, the ink compositions described herein include nonionic surfactant. Thus, if there is only one surfactant or there are multiple surfactants, one or more of the surfactants is a nonionic surfactant. The nonionic surfactant can be present in the ink composition at from 0.1 wt % to 3 wt %, or from 0.3 wt % to 1 wt %. The total surfactant content can be up to about 5 wt % of the ink compositions.

Various other additives may be employed to provide desired properties of the ink for specific applications. Examples of these additives include those added to inhibit the growth of harmful microorganisms. These additives may be biocides, fungicides, and other microbial agents, which are routinely used in ink formulations. Examples of suitable microbial agents include, but are not limited to, Acticid$^{e}$® (Thor Specialties Inc.), Nuosep$^{r}$™ (Nudex, Inc.), Ucarcid$^{e}$™ (Union carbide Corp.), Vancid$^{e}$® (R. T. Vanderbilt Co.), Proxe$^{l}$™ (ICI America), and combinations thereof. Sequestering agents such as EDTA (ethylene diamine tetra acetic acid) may be included to eliminate the deleterious effects of heavy metal impurities, and buffer solutions may be used to control the pH of the ink. Viscosity modifiers and buffers may also be present, as well as other additives known to those skilled in the art to modify properties of the ink as desired.

Figure 4:
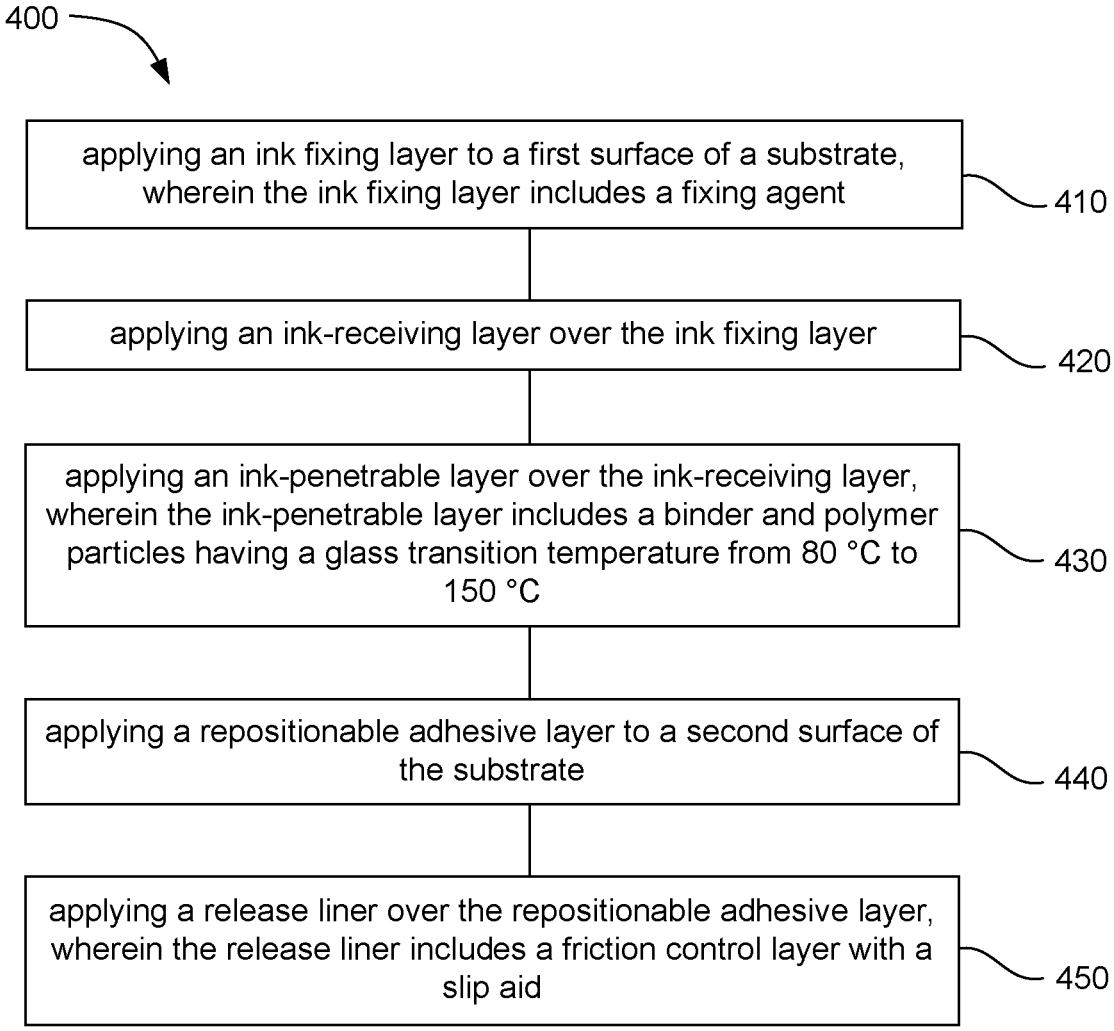
FIG. 4 is a flowchart illustrating an example method of making a printable medium in accordance with examples of the present disclosure.

The present disclosure also extends to methods of making a printable medium. FIG. 4 is a flowchart of an example method 400 of making a printable medium. The method includes applying 410 an ink fixing layer to a first surface of a substrate, wherein the ink fixing layer includes a fixing agent. The method can also include applying 420 an ink-receiving layer over the ink fixing layer, and applying 430 an ink-penetrable layer over the ink-receiving layer where the ink-penetrable layer includes a binder and polymer particles having a glass transition temperature from 80° C. to 150° C. Furthermore, the method can include applying 440 a repositionable adhesive layer to a second surface of the substrate, and applying 450 a release liner over the repositionable adhesive layer where the release liner includes a friction control layer with a slip aid.

It is noted that, as used in this specification and the appended claims, the singular forms "a," "an," and "the" include plural referents unless the content clearly dictates otherwise.

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include the numerical values explicitly recited as the limits of the range, and also to include all the individual numerical values or sub-ranges encompassed within that range as if each numerical value and sub-range is explicitly recited. For example, a weight ratio range of about 1 wt % to about 20 wt % should be interpreted to include the explicitly recited limits of 1 wt % and about 20 wt %, and also to include individual weights such as 2 wt %, 11 wt %, 14 wt %, and sub-ranges such as 10 wt % to 20 wt %, 5 wt % to 15 wt %, etc.

As a further note, in the present disclosure, it is noted that when discussing the print media and methods described herein, each of these discussions can be considered applicable to each of these examples, whether or not they are explicitly discussed in the context of that example. Thus, for example, in discussing details about the media, such discussion also refers to the methods, and vice versa.

Examples

Three sample printable media sheets were made using the following components. The substrate used was a cellulose base having a basis weight of 160 gsm. An ink fixing layer, ink-receiving layer, and ink-penetrable layer were applied to a front side of the cellulose base, and a repositionable adhesive layer was applied to the back side of the cellulose base. The layers had the compositions shown in Tables 1-4.

TABLE 1

(Ink-penetrable Layer)

| Ingredient | Ingredient Type | Parts by dry weight |
|---|---|---|
| RAYCAT ® 78 | Cationic polymer particles with a glass transition temperature (Tg) of 115° C., a zeta potential of +34 mV, and an average particle size of 0.24 micrometer | 50 |
| MOWIOL ® 4088 | Binder | 3 |
| Surfactant | Surfactant | 0.5 |

TABLE 2

(Ink-receiving Layer)

| Ingredient | Ingredient Type | Parts by dry weight |
|---|---|---|
| FOAMASTER ® VF | Defoamer | 0.2 |
| DYNEWET ® 800 | Wetting agent | 1 |
| polyDADMA | Ionene compound | 3 |
| DISPERAL ® HP-14 | Colloidal sol | 100 |
| MOWIOL ® 4088 | Binder | 10 |

TABLE 3

(Ink Fixing Layer)

| Ingredient | Ingredient Type | Parts by dry weight |
|---|---|---|
| Calcium Chloride | Cationic salt | 1 |
| PENFORD ™ 280 | Binder | 16 |

TABLE 4

(Repositionable Adhesive Layer)

| Ingredient | Ingredient Type | Parts by dry weight |
|---|---|---|
| 2-ethylhexyl acrylate | Continuous matrix polymer, average particle size 0.5 micrometer | 87 |
| Methyl methacrylate | Plastic particles, average particle size 15 micrometers | 5 |
| Acrylic acid | Crosslinking agent | 2 |
| 2-hydroxyethyl acrylate | Adhesive particles, average particle size 10 micrometers. | 4 |

RAYCAT ® 78 is a cationic polymer particle available from Specialty Polymers.
MOWIOL ® 4088 is a polyvinyl alcohol used as a binder available from Kuraray America, Inc.
FOAMASTER ® VF is an antifoaming agent available from BASF.
DYNEWET ® 800 is a wetting agent available from BYK.
DISPERAL ® HP-14 is a colloidal sol available from Sasol Performance Chemicals.
PENFORD ™ 280 is a starch derivative available from Penford Products Company.

In the ink-penetrable layer composition, RAYCAT® 78 was a cationic polymer particle having a glass transition temperature (Tg) within the range of 80° C. to 150° C. Specifically, the glass transition temperature (Tg) was 115° C. Additionally, the RAYCAT® 78 polymer particles had a zeta potential within the range of +1 mV to +50 mV. Specifically, the zeta potential was +34 mV. The average particle size of the RAYCAT® 78 particles was 0.24 micrometer, which is within the range of 0.1 micrometer to 2 micrometers. The MOWIOL® 4088 was a polyvinyl alcohol used as a binder. Because a relatively small amount of MOWIOL® 4088 was used compared to the amount of RAYCAT® 78, the particles of RAYCAT® 78 were bound together by the MOWIOL® 4088, but there was still void space left between the particles. The void space between particles was sufficient to provide pathways for a non-latex ink to penetrate through the ink-penetrable layer.

In the ink-receiving layer composition, the DISPERAL® HP-14 is a colloidal sol of boehmite. The polyDADMA is an ionene compound.

In the ink fixing layer composition, the calcium chloride is a cationic salt, which is a fixing agent. The PENDFORD™ 280 is used as a binder.

In the repositionable adhesive layer composition shown above, the 2-ethylhexyl acrylate is a continuous matrix polymer made up of particles having an average particle size of 0.5 micrometer or 500 nanometers, which is within the range of 50 nanometers to 800 nanometers. The methyl methacrylate is a plastic particle having an average particle size of 15 micrometers. The acrylic acid is a crosslinking agent to cross link the polymers in the layer. The 2-hydroxyethyl acrylate is an adhesive particle, with an average particle size of 10 micrometers. The ratio of the average particle size of the adhesive particles to the average size of the continuous matrix polymer particles is 20:1, which is in the range of 20:1 to 100:1.

The substrate used in the examples was a cellulose base paper that had an opacity of about 95%, which is in the range of 94% to 100%.

Three samples (EXP-1, EXP-2, EXP-3) were made. The first had a coat weight of 1 gsm for the ink-penetrable layer. The second had a coat weight of 3 gsm for the ink-penetrable layer. The third had a coat weight of 5 gsm for the ink-penetrable layer. The coat weights of the other layers were held constant across the three samples, with the coat weights shown in Table 5. The samples were tested for color gamut, L*min, 75 degree gloss, dry smudge, bleed, and coalescence. The test results are shown in Table 6.

TABLE 5

(Coating Weight - gsm)

| Sample ID | EXP-1 | EXP-2 | EXP-3 |
|---|---|---|---|
| Ink-penetrable layer | 1 | 3 | 5 |
| Ink-receiving Layer | 7 | 7 | 7 |
| Ink Fixing Layer | 1 | 1 | 1 |
| Substrate | 160 | 160 | 160 |
| Repositionable Adhesive Layer | 25 | 25 | 25 |
| Release Liner | 40 | 40 | 40 |
| Friction Control Layer | 0.5 | 0.5 | 0.5 |

TABLE 6

(Test Results)

| Sample ID | EXP-1 | EXP-2 | EXP-3 |
|---|---|---|---|
| Gamut (K) | 367 | 348 | 331 |
| L * min | 10.1 | 11.2 | 12.5 |
| 75° gloss (%) | 54 | 57 | 56 |
| Dry to touch Smudge (5 best) | 4 | 5 | 5 |
| Bleed (5 best) | 4 | 3 | 2 |
| Coalescence (5 best) | 4 | 4 | 4 |

Gamut measurement (Gamut) represents the amount of color space covered by the ink on the media. Gamut volume is calculated using L*a*b* values of 8 colors (cyan, magenta, yellow, black, red, green, blue, white) measured with an X-RITE®939 Spectro-densitometer (X-Rite Corporation), using D65 illuminant and 2° observer angle. L*min value testing is carried out on a black printed area and is measured with an X-RITE®939 Spectro-densitometer, using D65 illuminant and 2° observer angle. This measure determines how "black" the black color is. A lower score indicates a better performance. 75 degree gloss in the table is referred as the "Sheet Gloss" and measures how much light is reflected with a 75° geometry on the unprinted recording media. 75° Sheet Gloss testing is carried out by Gloss measurement of the unprinted area of the sheet with a BYK-Gardner Micro-Gloss® 75° Meter (BYK-Gardner USA, Columbia, Md., USA). Dry to touch Smudge is determined by visual rankings from 1 to 5, with 5 having the least ink smudge and 1 having the most ink smudge after smearing black (R=G=B=0) smudge rectangles immediately after the printing, with a neoprene (Safeskin® Hypoclean Critical™ Latex Gloves—HC1380S) glove tip secured by an O-ring on an earplug (Moldex Pura-Fit® #6800) that was attached to a Smeartron pen. Bleed testing is carried out with a bleed stinger pattern. Lines of cyan, magenta, yellow, black, red, green, blue inks, passing through solid area fills of each color, are printed. The bleed is evaluated visually for acceptability. The samples are given a rating score according to a 1 to 5 scale (wherein 1 means the worst color-to-color bleed performance, 5 represents the best color-to-color bleed performance). The coalescence is also evaluated visually for acceptability. The samples are given a rating score according to a 1 to 5 scale (wherein 1 means the worst performance and 5 represents the best performance).

In this example, the media sheet was tested without providing a release liner or friction control layer. However, in another example, a release liner and friction control layer can be added having the compositions shown in Tables 7-8.

TABLE 7

(Release Liner)

| Ingredient | Ingredient Type | Parts by dry weight |
|---|---|---|
| SILCOLEASE ® 7460 | Silicone monomer | 1 |
| SILCOLEASE ® 93B | Silicone monomer | 0.012 |
| SILCOLEASE ® RCA | Silicone monomer | 0.015 |
| Methylhexane | Solvent | 25 |

TABLE 8

(Friction Control Layer)

| Ingredient | Ingredient Type | Parts by dry weight |
|---|---|---|
| MOWIOL ® 56-98 | Binder | 20 |
| SILWET ® L7600 | Surfactant | 0.5 |
| ORGASOL ® 2002 ES3 NAT 3 | Polymeric slip aid | 30 |
| ULTRALUBE ® E846 | Polymeric slip aid | 7 |
| Glycerol | Solvent | 2 |

SILCOLEASE ® 7460, SILCOLEASE 93B, and SILCOLEASE RCA are silicone monomers available from Bluestar Silicones.
MOWIOL ® 56-98 is a polyvinyl alcohol used as a binder available from Kuraray America, Inc.
SILWET ® L7600 is a surfactant available from Fitzgerald Industries International.
ORGASOL ® 2002 ES3 NAT 3 is polyamide powder used as a slip aid available from Arkema, Inc.
ULTRALUBE ® E846 is a wax emulsion used as a slip aid available from Keim Additec Surface.

In the above compositions, the ORGASOL® 2002 ES3 NAT 3 and ULTRALUBE® E846 are both polymeric slip aids.

In contrast, a printable medium can be made using the same compositions as listed above, except that instead of RAYCAT® 78 in the ink-penetrable layer, a different polymer having a glass transition temperature below 80° C. can be used. In this comparative example, the polymer with the lower glass transition temperature can form a film during manufacture or under some printing conditions, resulting in a non-porous layer. When ink is printed on this medium, the ink tends to remain on the outermost surface of the medium instead of penetrating the ink-receiving or ink fixing layers, leading to often inferior smudge and bleed performance.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions, and figures used herein are set forth by way of illustration and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A printable medium, comprising:

a substrate having a first side and a second side;

an ink-receiving layer positioned on the first side of the substrate, wherein the ink-receiving layer comprises colloidal sol;

an ink-penetrable layer positioned on the ink-receiving layer, wherein the ink-penetrable layer comprises a binder and polymer particles having a glass transition temperature from 80° C. to 150° C.;

a repositionable adhesive layer positioned on the second side of the substrate, the repositionable adhesive layer comprising a continuous matrix polymer including a field of polymer or polymer particles, wherein the repositionable adhesive layer further includes adhesive particles and plastic particles dispersed in the continuous matrix polymer;

a release liner removably positioned on the repositionable adhesive layer; and a friction control layer positioned on the release liner, wherein the friction control layer comprises a slip aid.

2. The printable medium of claim 1, wherein the substrate has an opacity of 94% to 100%.

3. The printable medium of claim 1, wherein the substrate is a cellulose base, a non-woven paper base, or a non-woven synthetic fiber base.

4. The printable medium of claim 1, further comprising an ink fixing layer positioned between the ink-receiving layer and the substrate, wherein the ink fixing layer comprises a cationic salt.

5. The printable medium of claim 1, wherein the ink-receiving layer further comprises an ionene compound.

6. The printable medium of claim 1, wherein the polymer particles of the ink-penetrable layer have an average particle size from 0.1 micrometer to 2 micrometers.

7. The printable medium of claim 1, wherein the polymer particles of the ink-penetrable layer comprise a cationic polymer having a zeta potential from +1 mV to +50 mV.

8. The printable medium of claim 1, wherein the continuous matrix polymer comprises the polymer particles, and the polymer particles have an average particle size from 50 nanometers to 800 nanometers, and wherein a ratio of the average particle size of the adhesive particles to the average particle size of the polymer particles of the continuous matrix polymer is from 20:1 to 100:1.

9. The printable medium of claim 1, wherein the slip aid is a polymeric slip aid.

10. A method of printing, comprising jetting a non-latex ink onto a printable medium using a thermal inkjet printer, wherein the ink comprises a colorant and a solvent, and wherein the printable medium comprises:

a substrate having a first side and a second side;

an ink-receiving layer positioned on the first side of the substrate, wherein the ink-receiving layer comprises colloidal sol;

an ink-penetrable layer positioned on the ink-receiving layer, wherein the ink-penetrable layer comprises a binder and polymer particles having a glass transition temperature from 80° C. to 150° C.;

a repositionable adhesive layer positioned on the second side of the substrate, the repositionable adhesive layer comprising a continuous matrix polymer including a field of polymer or polymer particles, wherein the repositionable adhesive layer further includes adhesive particles and plastic particles dispersed in the continuous matrix polymer;

a release liner removably positioned on the repositionable adhesive layer; and a friction control layer positioned on the release liner, wherein the friction control layer comprises a slip aid.

11. The method of claim 10, wherein the polymer particles of the ink-penetrable layer comprise cationic polymer particles having a zeta potential from +1 mV to +50 mV having an average particle size from 0.1 micrometer to 2 micrometers.

12. The method of claim 10, wherein the repositionable adhesive layer comprises:

the field of polymer or polymer particles includes polymer particles having an average particle size from 50 nanometers to 800 nanometers, and wherein a ratio of the average particle size of the adhesive particles to the average particle size of the polymer particles continuous matrix polymer is from 20:1 to 100:1.

13. A method of making a printable medium, comprising:

applying an ink-receiving layer over a first side of a substrate;

applying an ink-penetrable layer over the ink-receiving layer, wherein the ink-penetrable layer comprises a binder and polymer particles having a glass transition temperature from 80° C. to 150° C.;

applying a repositionable adhesive layer to a second surface of the substrate, the repositionable adhesive layer comprising a continuous matrix polymer including a field of polymer or polymer particles, wherein the repositionable adhesive layer further includes adhesive particles and plastic particles dispersed in the continuous matrix polymer;

applying a release liner over the repositionable adhesive layer so that the release liner is removably positioned on the repositionable adhesive layer; and applying a friction control layer on the release liner, wherein the friction control layer comprises a slip aid.

14. The method of claim 13, wherein the polymer particles of the ink-penetrable layer comprise cationic polymer particles having a zeta potential from +1 mV to +50 mV having an average particle size from 0.1 micrometer to 2 micrometers.

15. The method of claim 13, further comprising applying an ink fixing layer to a first surface of a substrate prior to applying the ink-receiving layer, wherein the ink fixing layer comprises a cationic salt.

16. The method of claim 13, wherein the substrate has an opacity of 94% to 100%.

17. The method of claim 13, wherein the ink-receiving layer further comprises an ionene compound.

18. The method of claim 13, wherein the polymer particles of the ink-penetrable layer have an average particle size from 0.1 micrometer to 2 micrometers.

19. The method of claim 13, wherein the polymer particles of the ink-penetrable layer comprise a cationic polymer having a zeta potential from +1 mV to +50 mV.

20. The method of claim 13, wherein the continuous matrix polymer comprises the polymer particles, and the polymer particles have an average particle size from 50 nanometers to 800 nanometers, and wherein a ratio of the average particle size of the adhesive particles to the average particle size of the polymer particles of the continuous matrix polymer is from 20:1 to 100:1.

* * * * *